US011898823B2

(12) United States Patent
Tannenbaum

(10) Patent No.: US 11,898,823 B2
(45) Date of Patent: Feb. 13, 2024

(54) NON-LETHAL CROWD-CONTROL SYSTEM

(71) Applicant: Adam Benjamin Tannenbaum, Ashdod (IL)

(72) Inventor: Adam Benjamin Tannenbaum, Ashdod (IL)

( * ) Notice: Subject to any disclaimer, the term of this patent is extended or adjusted under 35 U.S.C. 154(b) by 18 days.

(21) Appl. No.: 17/861,227

(22) Filed: Jul. 10, 2022

(65) Prior Publication Data

US 2024/0011745 A1 Jan. 11, 2024

(51) Int. Cl.
*F41H 13/00* (2006.01)

(52) U.S. Cl.
CPC ..... *F41H 13/0081* (2013.01)

(58) Field of Classification Search
CPC ..... F41H 13/0081
See application file for complete search history.

(56) References Cited

U.S. PATENT DOCUMENTS 4,658,385 A * 4/1987 Tsuji ..... G01S 15/931 340/904
4,658,386 A * 4/1987 Morris ..... A01M 29/18 340/573.2
7,206,257 B1 * 4/2007 Meng ..... G10K 15/02 367/137
7,930,977 B2 * 4/2011 Klein ..... F42B 7/08 102/447
8,245,617 B2 * 8/2012 Martinez ..... F42B 23/10 114/382
8,403,106 B2 * 3/2013 Bostick ..... F41H 5/08 181/142
8,757,039 B2 * 6/2014 Martinez ..... B63G 9/04 404/6
10,288,398 B1 * 5/2019 Verini ..... F42B 5/145
2005/0116090 A1 * 6/2005 Welty ..... F42B 25/00 244/13
2006/0233049 A1 * 10/2006 Cilliers ..... A01M 29/18 367/139
2018/0206817 A1 * 7/2018 Wegner ..... A61B 8/4461

FOREIGN PATENT DOCUMENTS

CA 3005690 C * 3/2023 ..... A61B 5/128
CN 102767991 A * 11/2012 ..... F41H 13/0081
CN 107205720 A * 9/2017 ..... A61B 8/0808

OTHER PUBLICATIONS

Leighton; Are some people suffering as a result of increasing mass exposure of the public to ; ultrasound in air?; pp. 1-57; 2016 (Year: 2016).*

* cited by examiner

*Primary Examiner* — Daniel Pihulic
(74) *Attorney, Agent, or Firm* — Robert Brownstein

(57) ABSTRACT

The invention herein disclosed is a non-lethal crowd-control system that uses ultrasonic sound waves to induce disarming sensations of tickling/tingling upon persons in a hostile/violent crowd who are located within a zone of desired crowd control. The sensations can cause persons to cease current behavior and attempt to eliminate the sensations. Moving backwards out of the areal zone of control will reduce or eliminate the sensations. As a result a control zone area is established without use of batons, sprays or rubber-bullet loaded weaponry.

4 Claims, 6 Drawing Sheets

NON-LETHAL CROWD-CONTROL SYSTEM

TECHNICAL FIELD

The invention is a system for controlling a crowd, that could become hostile, using non-invasive, non-lethal means.

BACKGROUND OF INVENTION

Wherever a large crowd of people gather, there is always a possibility of violent mob behavior. Law enforcement personnel have a limited variety of crowd-control means absent the use of lethal force. Personnel may be armed with shields and batons; they may be equipped with irritant gas or spray dispersal systems; and in extreme cases, they may be armed with rubber-bullet loaded weapons. However, all of these means, intended to avoid serious injury, involve striking, or causing irritant reaction, or shooting with ammunition designed to avoid penetration. In some cases, someone struck with a baton may suffer a concussion. Someone inhaling tear gas or pepper spray may have an asthmatic reaction. And, rubber bullets are notorious for causing eye injuries.

Systems, such as tasers, may be effective in resolving a violent outbreak by a single individual, but they are inappropriate for crowd control. When law enforcement officers are far outnumbered by a crowd, crowd control can become ineffective.

Striking someone, gassing or spraying someone, or shooting someone with rubber bullets all involve some degree of violence, and all have the propensity for lethal consequences.

If there was a crowd-control system that caused mob members to literally stop in their tracks and respond to some kind of disarming sensation, it could cause a surging mob to quickly lose its momentum and allow for controlling the crowd with minimal risk of injury.

Sensations that are known to cause people to pause in any endeavor and respond to them are extremely loud sounds, electrical shock, a burning sensation, a freezing sensation, being tickled and feeling a tingling sensation. Loud sounds and electric shocks can cause serious injuries. Extreme hot or cold sensations may be caused by applying hot or cold to the skin, and could also cause serious injuries. However, a tickling or tingling sensation may be induced without causing injury. A system that could reliably induce those sensations could be effective for crowd control.

BRIEF DESCRIPTION OF INVENTION

The invention herein disclosed and claimed is a system that produces ultrasonic sound, forms directional sound beams which then wash over peoples' clothing and bare skin causing tickling/tingling sensations that are shown to disrupt violent behavior. Since nothing penetrates the skin, or stimulates the auditory system organs and nerves, it represents a non-invasive, non-lethal crowd-control capability.

The ultrasonic sound is produced by a generator operative to create electrical signals with frequencies well above audible frequencies. These electrical signals are then amplified, and multiplexed to produce multiple identical signal outputs. These output signals are processed by microcontroller-based adjustable phase subsystems and the phased output signals are conveyed to individual transducers in an array of transducers.

The ultrasonic sound waves, appropriately phased, produce a series of destructive and constructive interference patterns such that a beam of high-energy waves is produced. This directional ultrasonic beam can then be directed toward people acting in hostile/violent fashion, or it can be used to render a zone in which people who enter will be exposed to tickling/tingling sensations. The system creates a tickling and tingling sensation on the skin, particularly at an area near the base of the skull which may cause some excretion of oxytocin. The combination of sensation and oxytocin is shown to disrupt behavior, effectively quelling hostile, violent intent and action.

DETAILED DESCRIPTION OF INVENTION

Figure 1:
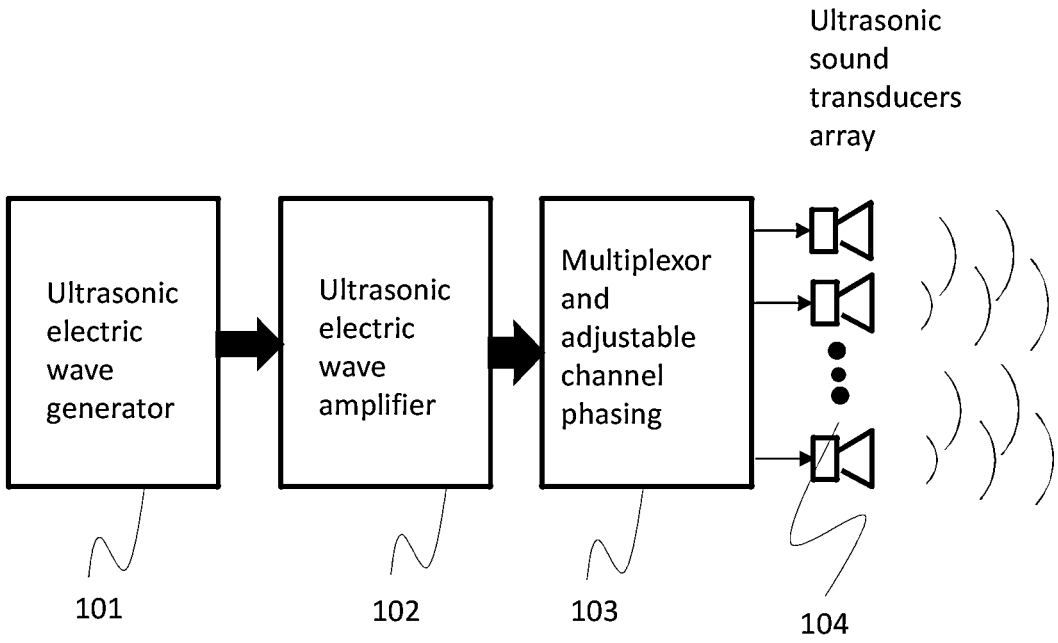
FIG. 1 shows a system overview

Societies, in general, are at some degree of risk of large gatherings of people who may become hostile or violent. Where a crowd of hundreds or even thousands of people gather and become incited, a much smaller number of law enforcement personnel are hard pressed to control such a crowd using non-injurious or non-lethal means. The events at the US Capitol on Jan. 6, 2021 show exactly what can happen when a crowd topples physical barriers and attacks the much smaller number of law enforcement personnel.

Commonly deployed crowd-control means may involve helmets/shields/batons, gases (such as tear gas) or sprays (such as pepper sprays), and in some cases rubber-bullet loaded weaponry. All of these control means have a significant degree of potential injury associated with them. All of these means are intended to disrupt hostile/violent action allowing a small number of law enforcement personnel to effectively stop and ultimately disperse a hostile crowd. As was shown on Jan. 6, 2021, these methods can fail to control a hostile crowd.

Experience has shown that when individuals in a mob-like crowd are faced with some disarming sensation, they essentially stop the hostile action and attempt to quell the disarming sensation. Extremely loud sounds will cause people to cover their ears, for example. A sensation of tickling/tingling will cause people to try to make it stop. In the process, they may drop any weapons and stop forward motion.

If a system can establish, say, an area in which people will all be subject to disarming sensations, humans tend to move back away from that area. This creates a zone in which hostile/violent action is thwarted by such sensations.

Using gas as a means of crowd control is ineffective in creating such a zone because it rapidly disperses and wind will quickly reduce its concentration. Batons or rubber-bullet loaded weaponry cannot create such a zone because it is one-to-one rather than affecting a significant portion of a crowd.

The non-lethal crowd-control system disclosed and claimed herein is intended to create a zone of non-hostile/non-violent behavior by exposing anyone in that zone to sensations that are disarming. In this case, it is impingement by high-energy ultrasonic sound waves which cause a tickling/tingling sensation that cannot be ignored.

Using a generator to create ultrasonic-frequency electrical signals, then amplifying those signals, and multiplexing the amplified output so as have multiple, identical signals, each capable of exciting an ultrasonic transducer, will produce a field of ultrasonic sound energy in a broad direction. If the individual multiplexed signals are first modified to have specific phase differences relative to the original output signal, one can create a beam-formed output wherein sound of high energy is narrowed and focused in one direction whereas sound in other directions is significantly reduced by destructive interference.

The energy level of the beam will be at some peak level near the transducers and dissipate as the distance in the favored direction increases. In essence, by choosing an initial ultrasonic sound power level, and detecting the attenuation with distance, one can adjust the phasing in such a way as to create the aforementioned zone in which people who are impinged by the sound will experience disarming sensations whereas those further away will not.

That zone could be a circular field, or an arc of a circle, depending upon the number of systems deployed and the initial ultrasonic sound energy selected. Arguably, had such a system been deployed in a circle surrounding the US Capitol building, it may have prevented the breach of the building by keeping the crowd at bay some distance from the building.

The following provides further details about the invention system. In FIG. 1, the system comprises four subsystems: an ultrasonic electric wave generator (101) whose output frequency is user selectable, and ultrasonic electric wave amplifier (102) whose output power is user selectable; a multiplexor subsystem wherein the singular amplified input signal is multiplexed into a plurality of signals having identical characteristics plus an adjustable phasing portion that can alter the phase relationships of one or more of the plurality of signals (103); and an array of ultrasonic transducers (104). With regard to directionality, it is known that when dealing with audible sound frequencies, one can place a low-audible-frequency transducer (e.g. a woofer) anywhere in a room and there is virtually no sense of directionality. The sound seems to come from everywhere. In contrast, when using a high-audible-frequency transducer (e.g. a tweeter), these tend to produce a strong sense of directionality within, say, 20 feet. In a similar way, the ultrasonic transducers already are inherently directional so when augmented with phasing differences, it is possible to create a focused beam of high-energy ultrasonic waves.

Figure 2:
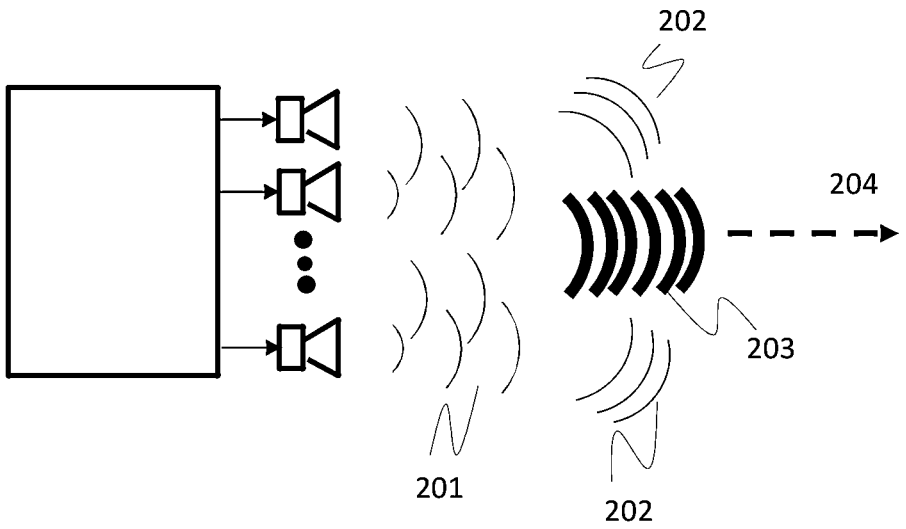
FIG. 2 illustrates how phased outputs produce a directional beam of higher-energy ultrasonic waves.
Figure 3:
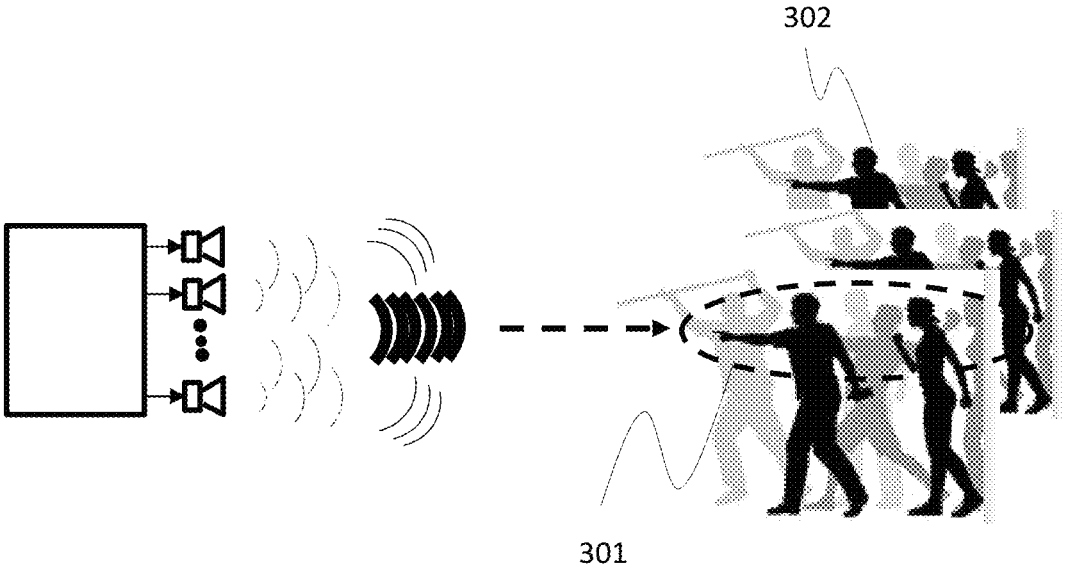
FIG. 3 illustrates how the beamed ultrasonic waves can be focused on a segment of a crowd.
Figure 4:
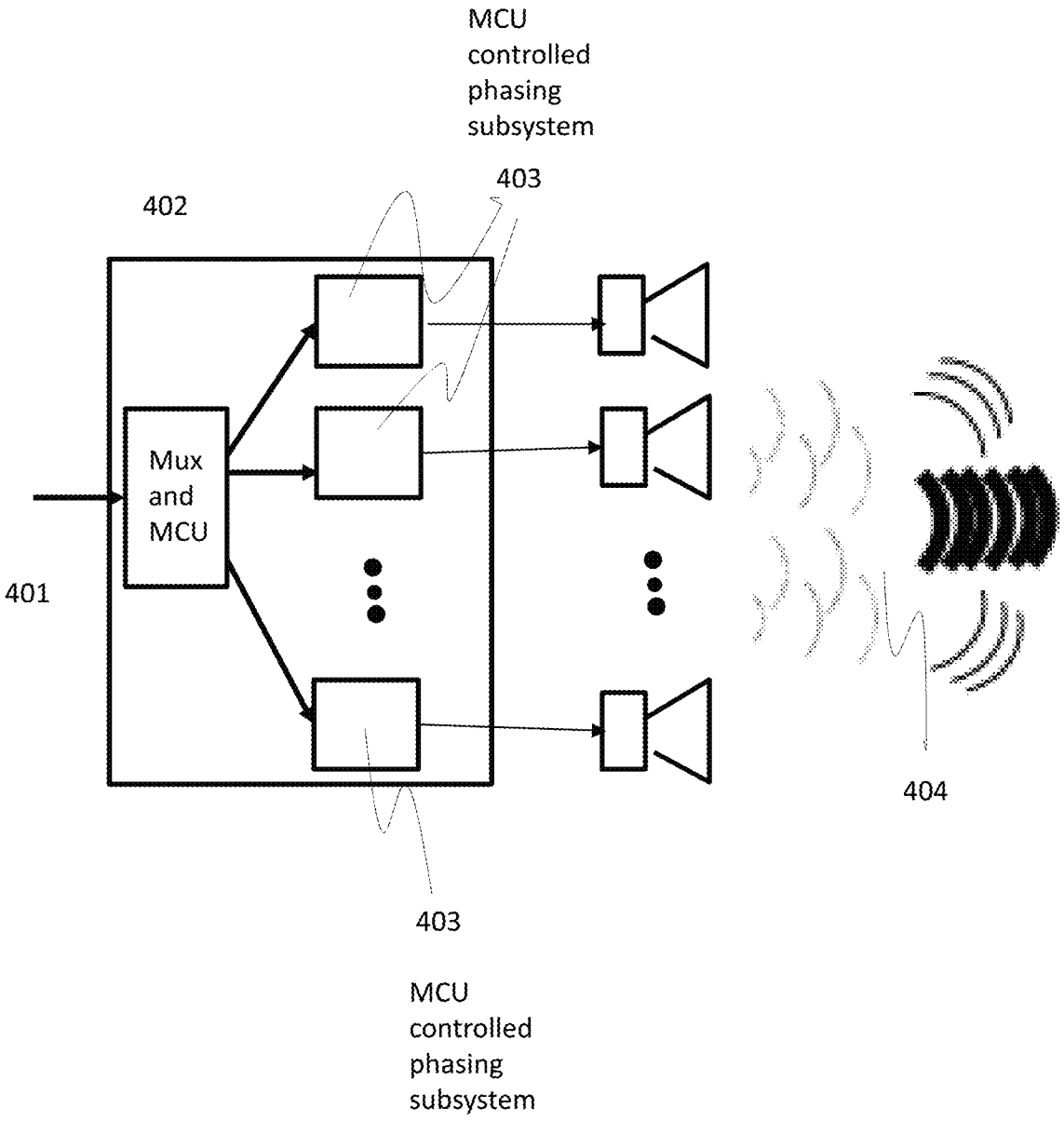
FIG. 4 shows the output of the amplifier being multiplexed and the individual signals then pass through phasing subsystems where the phase is based on microcontroller commands.

FIG. 2 illustrates how selective phasing of the signals feeding individual transducers can produce desired patterns of destructive and constructive interference effects (201) such that weakened energy (202) is skewed to the other directions whereas the strengthened beam (203) is narrow and directional in a chosen direction (204).

When the high-energy beam is directed at a segment of crowd within a zone of desired control (301), the ultrasonic waves produce a sensation of tickling/tingling to people in that segment. People in a segment outside the beam's path (302) would not experience those sensations. Multiple systems aimed at other segments within that desired zone of control will also create disarming sensations. The number of systems, and whether to sweep the beam back and forth, can be determined by the anticipated crowd size and zone area to be controlled.

To create the narrow, focused beam of ultrasonic waves, the output of the amplifier subsystem (401) is input to a multiplexor and microcontroller subsystem (402) wherein the single input signal is multiplexed into a plurality of individual signals have the same energy and phase relationships. These individual signals are conveyed to individual microcontroller-controlled phasing subsystems (403). Each such microcontroller-controlled phasing subsystem will apply a phase delay commanded by the microcontroller and convey the signal, with any phase delay, to an individual ultrasonic wave transducer. The phase delays cause predictable and selectable destructive and constructive interference such that a narrow, focused beam of high-energy ultrasonic waves (404) is created.

Figure 5:
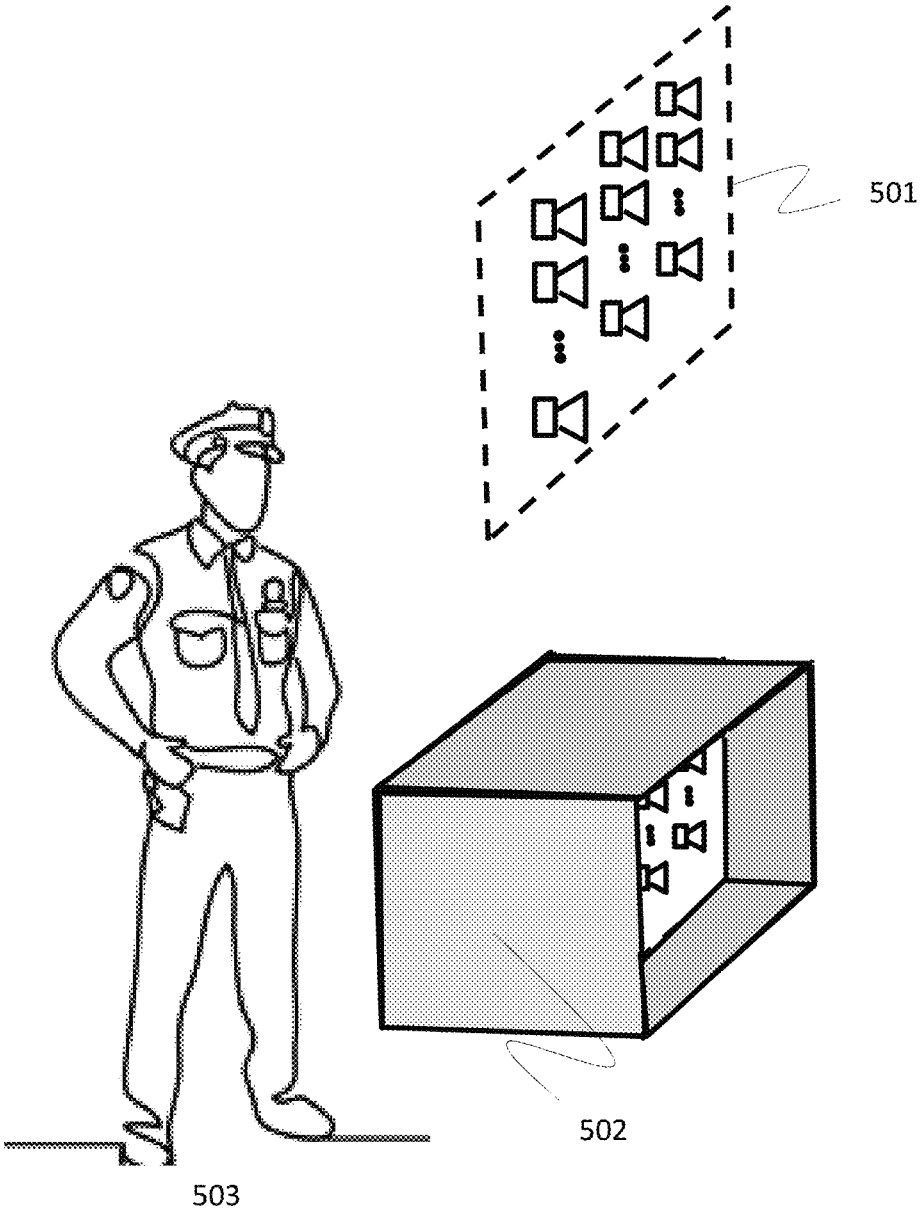
FIG. 5 shows how an array of transducers may be housed in a rectangular enclosure where one side is open in the direction of transducer output and the other sides are closed and covered with ultrasonic sound-absorbing materials.

Although the output of the transducers is inherently directional, a system user is in close proximity to the array of transducers (501). In FIG. 5 the array of transducers are organized in a rectangular plane and placed inside a rectangular enclosure (502) wherein one face is open in the direction of transducer output, and the other faces are closed and covered in ultrasonic-sound-absorbing materials. Consequently, a user (503) is effectively screened from the ultrasonic waves being produced and needs no protective clothing or other safeguards.

Figure 6:
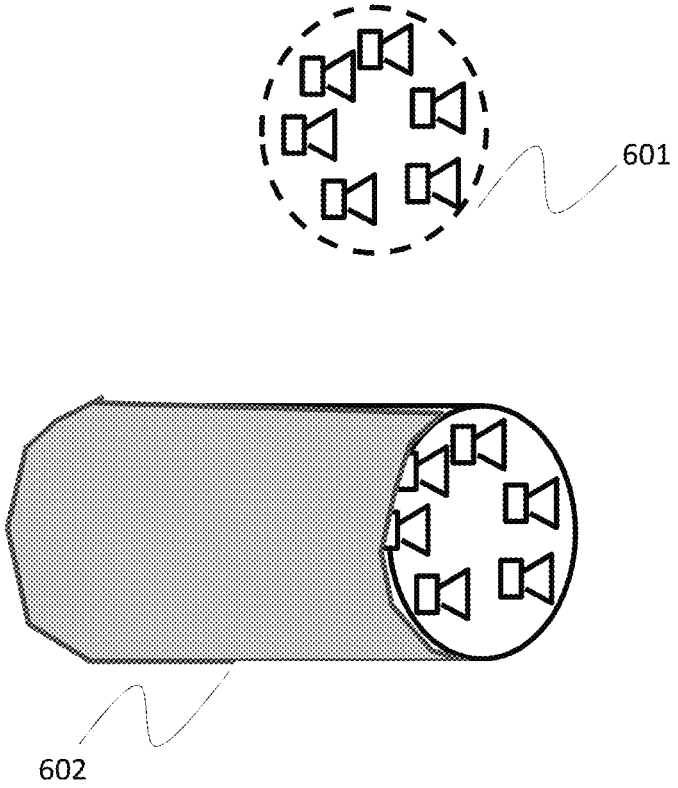
FIG. 6 shows an alternative implementation of transducers arranged in a circular array and enclosed in a cylindrical enclosure where one face is open in the direction of transducer output and the other face and cylinder are covered with ultrasonic sound-absorbing materials.

FIG. 6 illustrates another implementation wherein the transducers are organized in a circular planar array (601). This is then enclosed in a cylindrical enclosure wherein one end face is open in the direction of transducer output, and the cylindrical portion and other face, which is closed, are covered with ultrasonic-sound-absorbing materials. Again, the purpose is to protect the user from any ultrasonic waves propagating in a user's direction.

Please note, that the subsystems are shown as separate entities but one or more may be combined into a modular entity. For example, wave generator and wave amplifier may be part of one modular subsystem. In fact, wave generator, amplifier, multiplexor and adjustable phasing subsystems may be combined in a single modular entity. Similarly, the transducers are shown as organized in rectangular and circular planar arrangements and enclosed in rectangular and cylindrical enclosures. The transducer arrangement need not be planar nor rectangular or circular. A different organization of transducers may create a more compact system without compromising performance.

What is claimed is:

1. A system comprising:

an ultrasonic electric wave generator operative to produce electrical signals at user-selectable ultrasonic frequencies which when transduced to sound waves are known to evoke a tingling sensation on exposed human skin;

an ultrasonic electric wave amplifier operative to amplify incoming ultrasonic electric wave signals, to user-selectable power levels, wherein the amplified ultrasonic electric wave signals have essentially the same signal characteristics as said incoming ultrasonic electric wave signals, and enable a user to adjust power levels that just begin to evoke a tingling sensation when transduced to sound waves;

a multiplexor, microcontroller, adjustable phasing subsystem comprising:

a multiplexor operative to receive said amplified ultrasonic electric wave signal and multiplex said amplified ultrasonic electric wave signal into a plurality of outputs wherein each said output has essentially the same signal characteristics as said amplified ultrasonic electric wave signal; and an adjustable phasing subsystem operative to alter phase characteristics of said plurality of outputs, under programmed control of a microcontroller, after which each individual output of said plurality of outputs is conveyed to each individual ultrasonic sound transducer in an array of ultrasonic sound transducers.

2. A system as in claim 1 further comprising:

said array of ultrasonic sound transducers are enclosed within an ultrasonic-sound-absorbing enclosure having one face of said ultrasonic-sound-absorbing enclosure open so as to permit ultrasonic wave output of said array of ultrasonic sound transducers to propagate beyond said ultra-sonic-sound absorbing enclosure.

3. A method comprising:

selecting a distance range over which ultrasonic sound waves may induce tickling/tingling sensations;

selecting an ultrasonic sound wave amplifier power output determined to induce said tickling/tingling sensation of said distance range; and prompting a microcontroller to apply determined phase differences to identical signals conveyed to ultrasonic-sound transducers so as to create a beam-formed output determined to induce said tickling/tingling sensation at said distance range.

4. A method as in claim 3 further comprising:

sweeping said beam-formed output essentially horizontal to create a zone within which persons will experience said tickling/tingling sensations.

* * * * *